US011346622B2

(12) United States Patent
Heuss et al.

(10) Patent No.: US 11,346,622 B2
(45) Date of Patent: May 31, 2022

(54) FIREARM CHASSIS

(71) Applicant: Black Collar Arms, LLC, Austin, TX (US)

(72) Inventors: Christopher K. Heuss, Austin, TX (US); Jeremy M. Siwek, Round Rock, TX (US)

(73) Assignee: Black Collar Arms, LLC, Austin, TX (US)

( * ) Notice: Subject to any disclaimer, the term of this patent is extended or adjusted under 35 U.S.C. 154(b) by 0 days.

(21) Appl. No.: 17/150,023

(22) Filed: Jan. 15, 2021

(65) Prior Publication Data

US 2021/0278153 A1 Sep. 9, 2021

Related U.S. Application Data

(60) Provisional application No. 62/963,125, filed on Jan. 19, 2020.

(51) Int. Cl.
*F41A 3/66* (2006.01)
*F41C 23/16* (2006.01)

(52) U.S. Cl.
CPC ..... *F41A 3/66* (2013.01); *F41C 23/16* (2013.01)

(58) Field of Classification Search
CPC ..... F41A 3/66; F41C 23/16; F41C 27/00
See application file for complete search history.

(56) References Cited

U.S. PATENT DOCUMENTS

| | | | | |
|---|---|---|---|---|
| D591,822 | S | 5/2009 | Moody et al. | |
| 8,341,866 | B1 | 1/2013 | Gaddini et al. | |
| 8,341,868 | B2 | 1/2013 | Zusman | |
| 9,513,073 | B2 | 12/2016 | Sharps et al. | |
| 10,563,951 | B1 * | 2/2020 | Sharps | F41C 23/20 |
| 10,598,450 | B1 * | 3/2020 | Welch | F41A 11/02 |

* cited by examiner

*Primary Examiner* — J. Woodrow Eldred
(74) *Attorney, Agent, or Firm* — Weide & Miller, Ltd.

(57) ABSTRACT

A firearm chassis comprises a body having a receiver mount for receiving a firearm receiver or barreled action, and one or more mounting rails configured to removably accept one or more firearm features, wherein the mounting rails may comprise integrated Picatinny, Weaver or ARCA Swiss style rails, such as in vertical and/or horizontal orientations at the front and/or rear of the chassis. A firearm chassis may also be uniquely configured to utilize identical front and rear actions screws for attaching the firearm receiver or a barreled action thereto.

10 Claims, 5 Drawing Sheets

FIREARM CHASSIS

RELATED APPLICATION DATA

This application claims priority to U.S. Application Ser. No. 62/963,125, filed Jan. 19, 2020.

BACKGROUND

The disclosed embodiments relate to firearm chassis and more specifically to accessory attachment points on a firearm chassis.

Despite years of extensive development of firearms, existing firearms still suffer from various problems or drawbacks that can benefit from further innovation.

One problem with existing firearms relates to their assembly. In the case of firearms, a barrel action is connected to a stock or chassis with what are referred to as "action screws." Traditional stocks slope in the direction of the butt end to the fore end of the rifle, causing the stock to have a reduced dimension at the location of the barreled action towards the fore end of the rifle than it does in the direction of the butt end of the rifle. This requires that action screws of different lengths be used to connect the barrel action to the stock at different locations. In addition, various other fasteners may be used to assemble the firearm, such as to attach a grip to the chassis, which fasteners are different from the actions screws. This requires a firearm manufacturer to stock large numbers of different sized fasteners and ensure that the proper fasteners are used in proper locations, to assemble the firearm. Likewise, if an individual who is assembling or repairing a firearm will have difficulty doing so without having all of the different sized fasteners on hand.

Additionally, individuals frequently wish to modify their firearm to include one or more accessories or components. In the field of component attachment systems for firearms, rails are typically employed. Rails are mounts which are connected to a surface or portion of a firearm to facilitate the attachment of another item, such as an accessory or other component.

Rails were originally used to attach telescopic sights to rifles. However, their use has been expanded to include attachment of laser aiming modules, tactical lights, night vision devices, reflex sights, foregrips, bipods, bayonets and the like. The rails facilitate the mounting and dismounting of these components.

One problem with existing rail systems is that they are usually associated with the handguard or upper receiver of a firearm and extend generally horizontally. This limits the components that can be attached to the rail system and/or the orientation of the components which can be mounted thereto.

SUMMARY OF THE INVENTION

Embodiments of the invention relate to a firearm chassis.

One embodiment of the invention comprises a chassis for a firearm comprising a chassis body having a top, a bottom, a front end and a rear end, the body configured to receive a firearm receiver or barreled action, a first vertical mounting rail located at and extending outwardly from the front end of the body, and a second vertical mounting rail located at and extending outwardly from the rear end of the body, the first and second mounting rails configured to removably accept one or more firearm features.

The chassis may further comprise at least one horizontal mounting rail located at the top or bottom of the body. The mounting rails may have various configurations, such as comprising a Picatinny rail, a Weaver and/or an ARCA Swiss style rail.

The mounting rails may facilitate the mounting of various firearm accessories to the chassis, including but not limited to a grip and a stock.

In one embodiment, the chassis body and associated mounting rails are integrated, such as by being formed in a molding process or machining from metal stock.

Another embodiment of the invention comprises a chassis for a firearm comprising a chassis body having a top, a bottom, a front end and a rear end, the body having a receiver mount configured to receive a firearm receiver or barreled action, a front action screw aperture configured to receive a front action screw and a rear action screw aperture configured to receive a rear action screw, a distance from a front action screw seat of the front action screw aperture to the firearm receiver/barreled action and a distance from a rear action screw seat of the rear action screw aperture to the top of the chassis being the same, whereby identical front and rear action screws may be utilized to couple the firearm receiver/barreled action to the chassis.

In one embodiment, the chassis body may have a first height between the top and bottom at a location of the first action screw aperture and a second height between the top and bottom at a location of the second action screw aperture, the first and second heights being the same, whereby identical front and rear action screws may be utilized.

DETAILED DESCRIPTION OF EMBODIMENTS

Figure 1A:
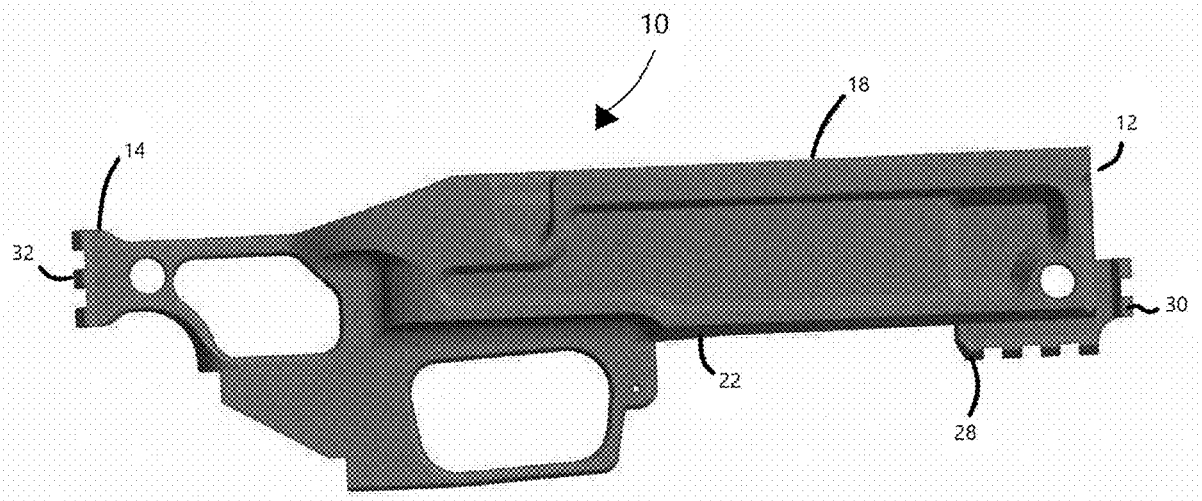
FIG. 1A is a side view of a firearm chasses with one or more integrated mounting rails in accordance with an embodiment of the invention.
Figure 1B:
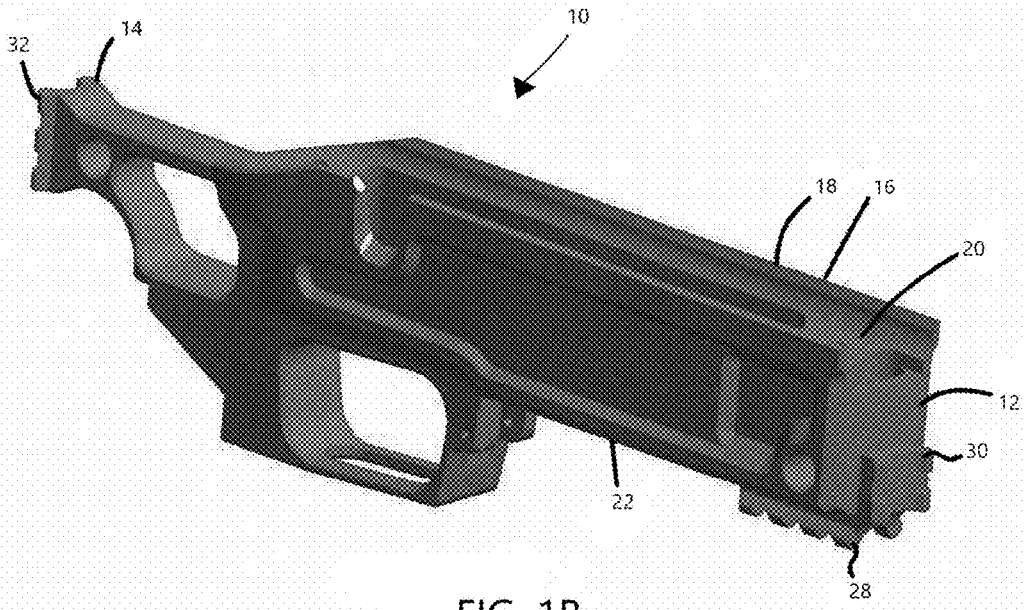
FIG. 1B is a front perspective view of the chassis illustrated in FIG. 1A.
Figure 1C:
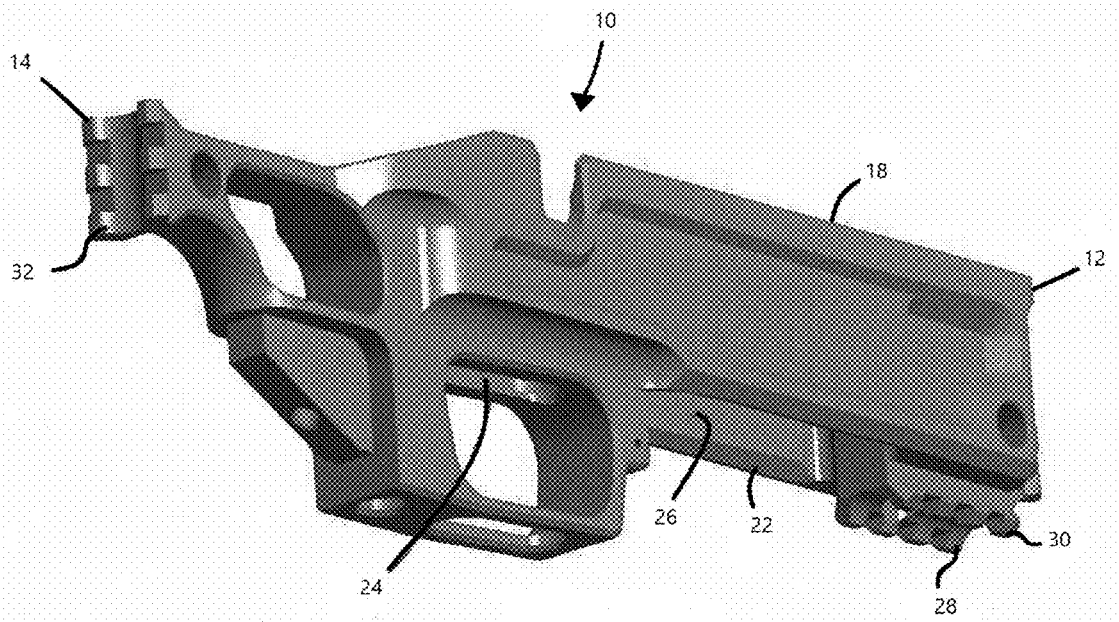
FIG. 1C is a bottom perspective view of the chassis illustrated in FIG. 1A.
Figure 1D:
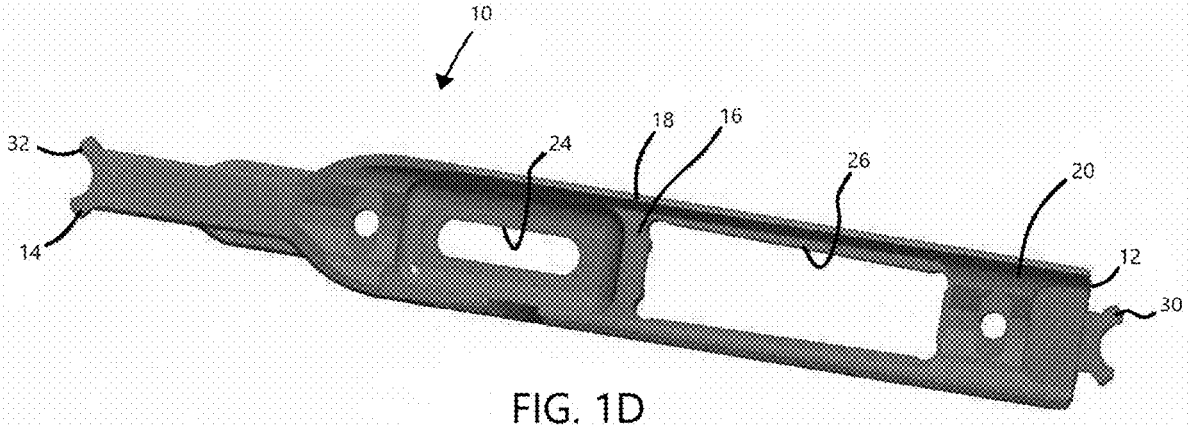
FIG. 1D is a top view of the chassis illustrated in FIG. 1A.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

A firearm chassis is disclosed herein. The firearm chassis may be configured to accept receivers of various types of firearms, such as a bolt-action receiver. In one embodiment of the invention, the chassis provides for a highly configurable and modular platform through the use of one or more associated, and preferably integrated, mounting rails, and most preferably Picatinny front and/or rear accessory mounting rails or interfaces. The chassis is effectively a modern alternative to a traditional wooden rifle stock, but allowing modular configuration and many advantages associated with modern materials and manufacturing, such as increased strength, lighter weight, improved accuracy, imperviousness to weather conditions, etc. In another embodiment of the invention, a firearm chassis is configured so that identical front and rear action screws may be utilized to mount a barreled action to the chassis, such as via a configuration of the chassis and/or a configuration of action screw apertures.

Referring to FIGS. 1A-1D, a chassis 10 is illustrated in accordance with one embodiment of the invention. Chassis 10 may comprise a body which has a front or fore end 12 and a rear or butt end 14 and generally has a top 18 and a bottom 22.

The chassis 10 is configured to accept or receive one or more firearm elements or features. Most importantly, the chassis 10 is configured to receive a firearm receiver (which generally then has an associated action and barrel) or may be configured to receive all or part of a barreled action, e.g., a receiver and associated action, barrel, etc.

Figure 2:
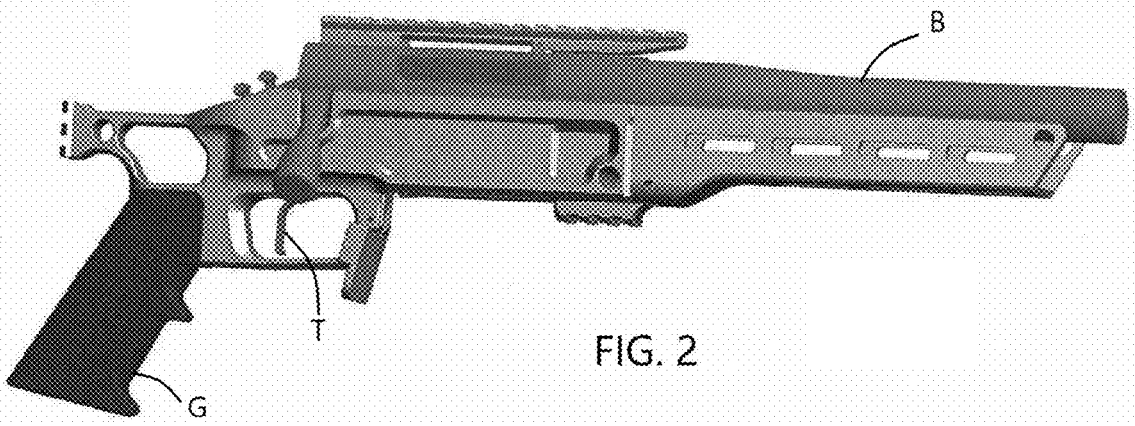
FIG. 2 shows exemplary attachments for a firearm chassis of the invention having one or more associated mounting rails.
Figure 3:
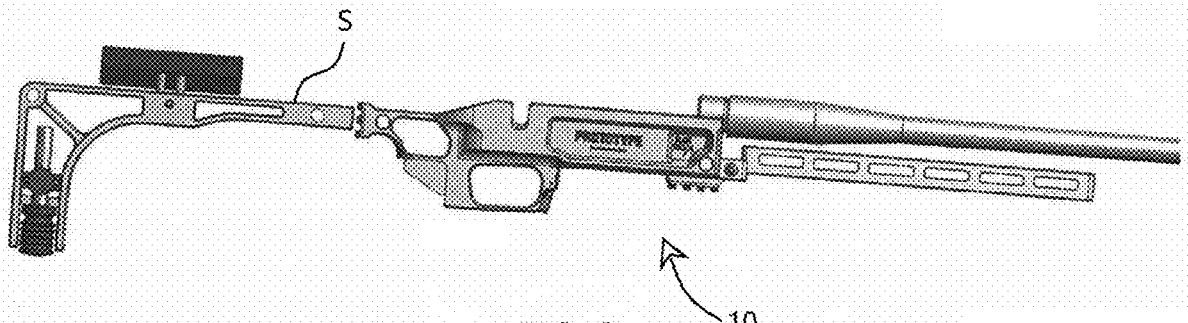
FIG. 3 shows exemplary attachments for a firearm chassis of the invention having one or more associated mounting rails.

In the preferred embodiment, the chassis 10 is sized to receive a firearm receiver between its front end 12 and rear end 14, such as in a receiver seat 20. The receiver seat 20 may comprise or include a cavity, depression or recess 16 extending from a top side 18 of the chassis 10, which recess 16 may be located between upwardly extending flanges or other structures. In this configuration, as best illustrated in FIGS. 2 and 3, a firearm receiver may be associated with the chassis 10, where a barrel B then extends from the receiver forwardly from the front 12 of the chassis 10. As shown, the barrel B might be supported by a barrel support or other feature or accessory which attached to a mounting rail at the front 12 of the chassis, as described below.

Chassis 10 may include various openings or other mounting features (slots/flanges, etc.) to facilitate installation and attachment of various other firearm elements. For example, a first opening 24 may be provided at the bottom 22 of the chassis 10 for receiving a trigger mechanism T therethrough (FIG. 2), and a second opening 26 may be provided for access to a magazine well receiver (not shown).

In one embodiment, the chassis 10 further comprises accessory attachment or mounting points, for removably accepting one or more firearm accessory elements. The attachment points preferably comprise a mounting rail, such as a Picatinny rail. As shown in FIGS. 1A-1D, in one embodiment, the chassis 10 includes a horizontal Picatinny rail 28 disposed on the bottom 22 of the chassis 10, adjacent to or at the front end 12. The rail 28 preferably extends downwardly below the chassis 10. Most preferably, the chassis 10 also includes one or more vertically extending or oriented attachment points, such as mounting rails. As illustrated, the chassis 10 may include a first vertical Picatinny rail 30 disposed on the front end 12, such as adjacent to a front end of the horizontal Picatinny rail 28. The chassis 10 may instead include, or may also include, a vertical Picatinny rail 30 disposed at the bottom of the chassis 10 at the front end 12. The chassis 10 may also include, alone or in combination with the other rails, a second vertical Picatinny rail 32 disposed on the rear end 14 of the chassis 10. Once again, these rails preferably extend outwardly from the chassis 10.

As used herein, the term "horizontal" generally means an orientation which is in the same direction as the barrel of the firearm, whereas the term "vertical" generally means an orientation which is generally perpendicular to the direction of the barrel of the firearm.

In a preferred embodiment, the chassis 10 is formed as a unitary member, wherein the first and second Picatinny rails are formed as integrated elements to the chassis 10. For example, the chassis 10, including the associated rails, may be formed in a molding process or in a machining process, such as from a metal stock. It will also be appreciated that the exact location of the mounting rails and other characteristics thereof, such as the length of the rails, may vary.

In the preferred embodiment the mounting rails are Picatinny-style rails. However, the rails could be other styles of rails, such as Weaver or ARCA Swiss style, or entirely proprietary rail designs. Such rails include one or more mounting elements, such as a outwardly extending flange having one or more grooves or slots, spaced blocks and the like, as is well known in the art.

The first and second vertical Picatinny rails 30, 32 provide several advantages for attaching accessories to the chassis 10. The first and second vertical Picatinny rails 30, 32 permit the removable attachment of various components or accessories to the chassis 10 (when those accessories have appropriate mating connectors for the mounting rail of the chassis, such as a Picatinny mount for when being connected to a chassis 10 including a Picatinny rail). For example, the second vertical Picatinny rail 32 at the rear 14 of the chassis 10 may facilitate mounting of various shoulder or tail stocks, pistol braces, and other accessories. The first vertical Picatinny rail 30 at the front 12 of the chassis 10 may facilitate the mounting of various handguards, accessory rails, bipods, grips, tail stocks, and the like. In one embodiment, the front and rear locations of the mounting rails permits connection of accessories that are positioned behind the rear of the chassis 10 and/or forwardly of the front of the chassis 10.

FIGS. 2 and 3 show exemplary accessories that may be attached to a chassis by way of the first and second vertical Picatinny rails. As shown in FIGS. 2 and 3, the vertical rails allow various different accessories, such as a grip G (attached to the rear vertical rail) and barrel support (attached to the front vertical rail) in FIG. 2 and a tail stock S (attached to the rear vertical rail) in FIG. 3, to be uniquely attached to the front and rear of the chassis 10. It will be appreciated that various accessories or other components which are now known or later developed may be connected via the first and/or second Picatinny rails, including but not limited to handguards, accessory rails, bipods, grips and the like. The vertical rails, including the front vertical rail, allow for the attachment of hereto before non-existent components or accessories. For example, new, unique components and accessories may be developed which are uniquely suited to vertical mounting. As one example, unique handguards, grips, fore-ends and other components may be developed which have mating vertically oriented connectors.

Most importantly, the vertically oriented rails 30, 32 facilitate removable or detachable mounting of various components that have a corresponding vertically oriented connector. This allows, such as illustrated in FIGS. 2 and 3, components or elements to be mounted to one another in a generally linear horizontal configuration (for example, the second or "rear" vertical rail on the chassis 10 allows a tail stock to be mounted to the rear of the chassis 10 in proper horizontal alignment therewith). An important aspect of the invention is the configuration of a firearm chassis 10 which is both configured to receive required firearm features such as a receiver (and associated elements such as a trigger, action, barrel, etc.) but also various optional features or accessories, thus allowing a manufacturer or individual owner to customize the base configuration of their firearm and not merely add accessories to an existing firearm.

Figure 4:
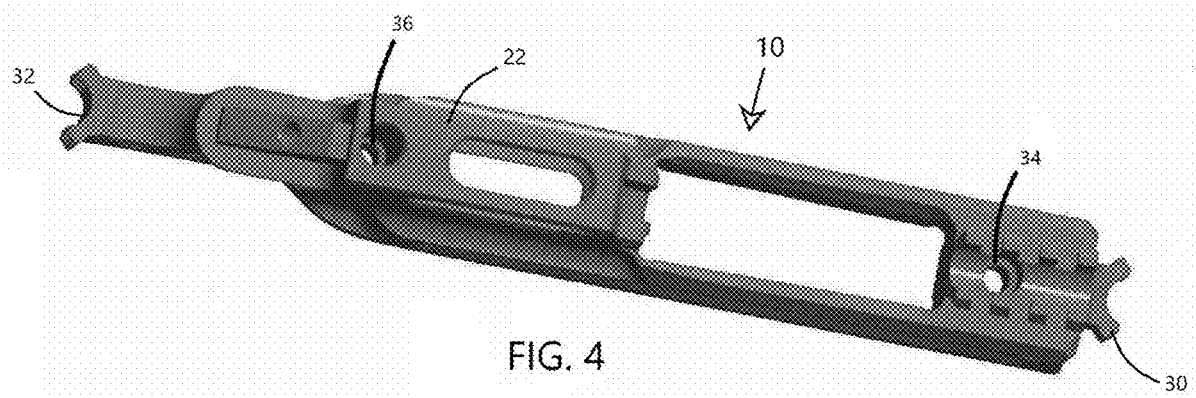
FIG. 4 is a bottom view of the firearm chassis illustrated in FIG. 1A illustrating another embodiment of the invention.
Figure 5:
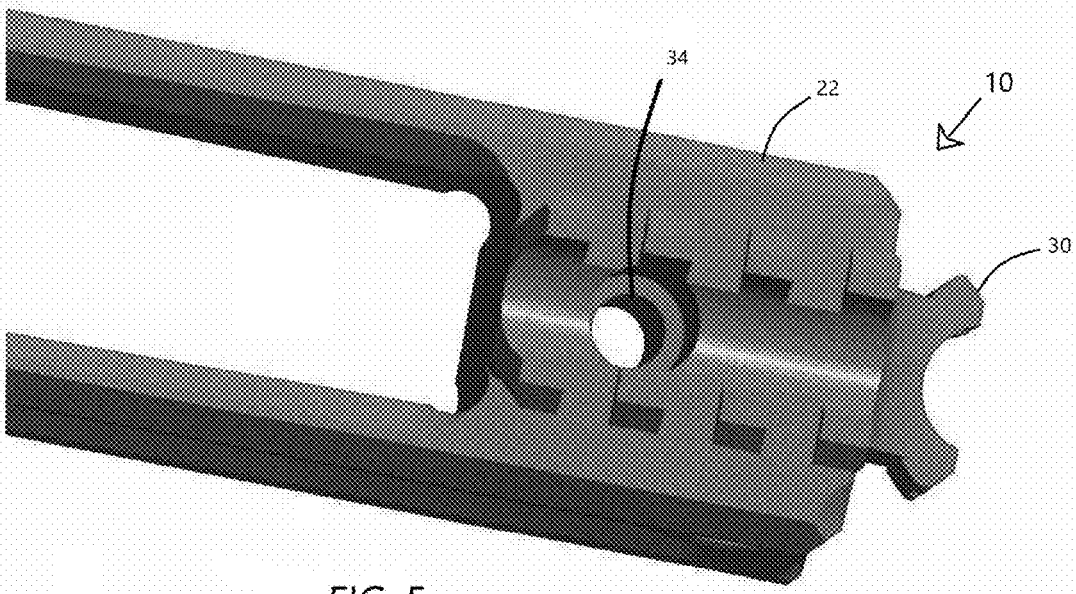
FIG. 5 is an enlarged view of a front action screw aperture of the chassis illustrated in FIG. 4.
Figure 6:
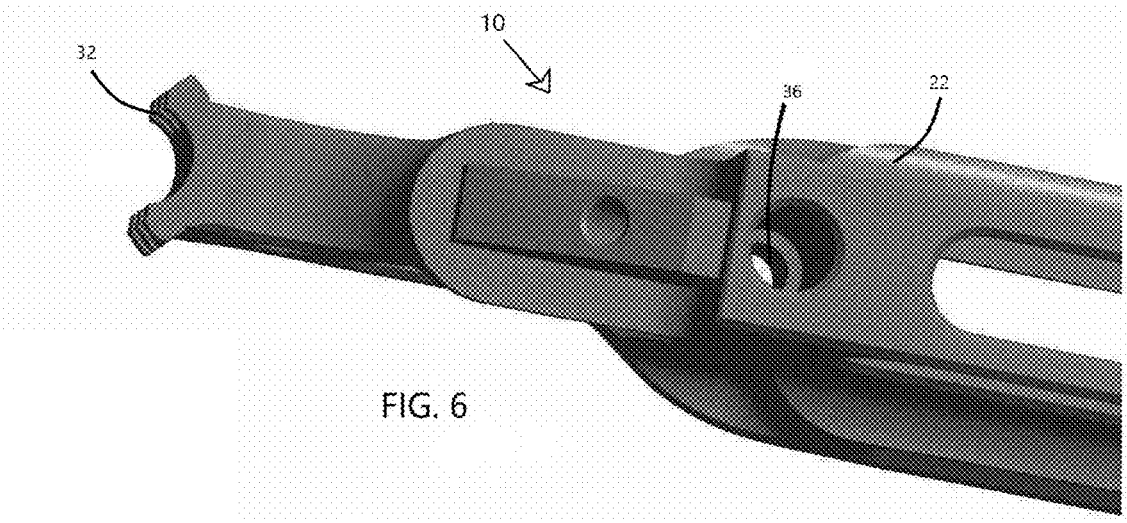
FIG. 6 is an enlarged view of a rear action screw aperture of the chassis illustrated in FIG. 4.

Another embodiment of the invention will be described with reference to FIGS. 4-6, which show a front action screw aperture 34 and a rear action screw aperture 36. The front and rear action screw apertures 34, 36 are configured to receive front and rear action screws (not shown) which are used to connect the firearm receiver or a barreled action, to the chassis 10. Particularly, the apertures 34, 36 are configured so that the front and rear action screws may be identical, including of the same length. In particular, the apertures 34, 36 are designed so that they each have the same length between a screw head seat (located at the bottom 22 of the chassis) and the receiver seat or mount 20 at the top of the chassis 10. This may be accomplished by having the height of the chassis 10 be constant or the same at the location of the aperture 34, 36, or by having countersinking or otherwise offsetting the screw head seats to a location that causes the lengths of the apertures 34, 36 (between the screw head seats and the point of contact with an associated firearm receiver or barreled action at the top of the chassis 10 at the location of the receiver mount 20) to be the same. Of course, this aspect of the invention may be applied to various firearm chassis, including those that do no include mounting rails of the invention, including chassis of other designs (including made of other materials, etc.)

Figure 7:
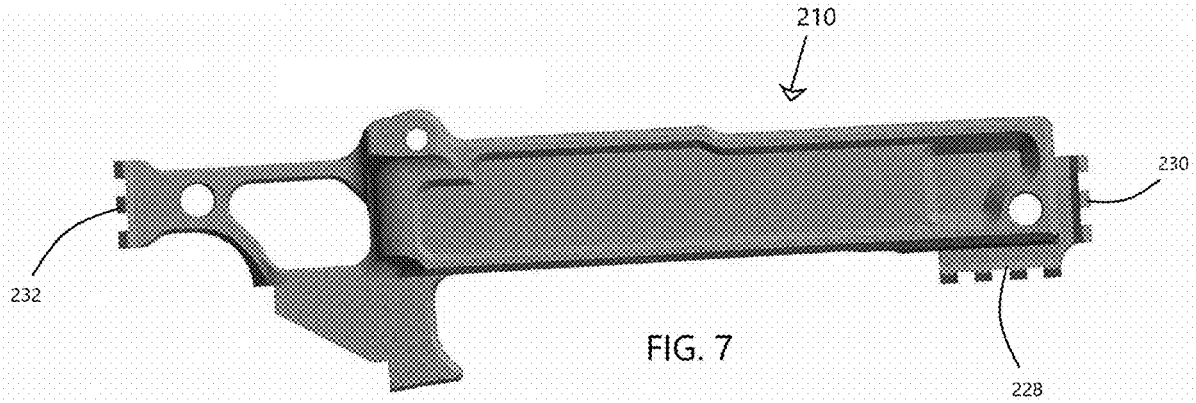
FIG. 7 shows an alternative firearm chassis with mounting rails according to another embodiment of the invention.

It will be appreciated that the above disclosed embodiments may be applied to other types of chassis in addition to the bolt-action chassis shown in FIGS. 1-6. As just one example, FIG. 7 shows mounting rails, such as front and rear vertical Picatinny rails 228, 230, 232, applied to a chassis 210 for a Ruger 10/22 receiver.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A chassis for a firearm comprising:

a chassis body having a top, a bottom, a front end and a rear end, said body having a receiver mount configured to receive a firearm receiver or barreled action, a first vertical mounting rail located at and extending outwardly from said front end of said body, and a second vertical mounting rail located at and extending outwardly from said rear end of said body, said first and second mounting rails configured to removably accept one or more firearm features.

2. The chassis in accordance with claim 1, further comprising at least one horizontal mounting rail located at said top or bottom of said body.

3. The chassis in accordance with claim 2, wherein said horizontal mounting rail is located at said bottom of said body at said front.

4. The chassis in accordance with claim 1, wherein said receiver mount comprises a recessed portion at said top of said chassis body.

5. The chassis in accordance with claim 1, wherein said first and second mounting rails comprise a Picatinny rail, a Weaver and/or an ARCA Swiss style rail.

6. The chassis in accordance with claim 1, wherein said one or more firearm features comprise a grip, a stock and a barrel support.

7. The chassis in accordance with claim 1, wherein said body and said associated first and second vertical mounting rails are integrated.

8. The chassis in accordance with claim 7, wherein said body and associated first and second vertical mounting rails are formed by molding.

9. The chassis in accordance with claim 7, wherein said body and associated first and second vertical mounting rails are formed by machining metal stock.

10. The chassis in accordance with claim 1, wherein said body further comprises a front action screw aperture configured to receive a front action screw and a rear action screw aperture configured to receive a rear action screw, a distance from a front action screw seat of said front action screw aperture to a first connection with said firearm receiver or barreled action and a distance from a rear action screw seat of said rear action screw aperture to a second connection with said receiver or barreled action being the same, whereby identical front and rear action screws may be utilized to couple said firearm receiver or barreled action to said chassis.

* * * * *